US008593240B2

(12) United States Patent
Rösch et al.

(10) Patent No.: US 8,593,240 B2
(45) Date of Patent: Nov. 26, 2013

(54) SHORT-CIRCUIT RELEASE HAVING AN OPTIMIZED COIL CONNECTION

(71) Applicants: Bernhard Rösch, Sulzbach-Rosenberg (DE); Yi Zhu, Darmstadt (DE)

(72) Inventors: Bernhard Rösch, Sulzbach-Rosenberg (DE); Yi Zhu, Darmstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/706,477

(22) Filed: Dec. 6, 2012

(65) Prior Publication Data

US 2013/0093541 A1 Apr. 18, 2013

Related U.S. Application Data

(62) Division of application No. 13/541,015, filed on Jul. 3, 2012.

(30) Foreign Application Priority Data

Jul. 5, 2011 (EP) ..... 11172627

(51) Int. Cl.
*H01H 9/00* (2006.01)

(52) U.S. Cl.
USPC ..... 335/172; 335/15

(58) Field of Classification Search
USPC ..... 335/172
See application file for complete search history.

(56) References Cited

U.S. PATENT DOCUMENTS

| | | | | |
|---|---|---|---|---|
| 4,443,775 | A | 4/1984 | Fujitani et al. | |
| 4,698,609 | A * | 10/1987 | Goehle et al. | 335/255 |
| 5,103,198 | A * | 4/1992 | Morel et al. | 335/6 |
| 5,565,828 | A * | 10/1996 | Flohr | 335/172 |
| 5,894,257 | A * | 4/1999 | Roger et al. | 335/172 |
| 6,225,883 | B1 * | 5/2001 | Wellner et al. | 335/172 |
| 6,300,853 | B1 * | 10/2001 | Grafenhahn et al. | 335/176 |
| 6,577,217 | B1 * | 6/2003 | Bournarie et al. | 335/282 |
| 2002/0063615 | A1 | 5/2002 | Nomura et al. | |

FOREIGN PATENT DOCUMENTS

| | | |
|---|---|---|
| DE | 19952179 | 5/2001 |
| DE | 102009037250 | 2/2011 |
| EP | 0501844 | 9/1992 |
| EP | 0849761 | 6/1998 |
| FR | 2753836 | 3/1998 |
| FR | 2779567 | 12/1999 |
| WO | WO 01/33597 | 5/2001 |

OTHER PUBLICATIONS

European priority document application No. EP 11172627.9 filed Jul. 5, 2011 (not yet published).
European Search Report.
Office Action for corresponding U.S. Appl. No. 13/541,015 dated Feb. 25, 2013.

* cited by examiner

*Primary Examiner* — Elvin G Enad
*Assistant Examiner* — Lisa Homza
(74) *Attorney, Agent, or Firm* — Harness, Dickey & Pierce, P.L.C.

(57) ABSTRACT

A short-circuit release is disclosed, in particular for a power circuit-breaker, including an armature and a pole, that are located inside of a coil element; and a yoke plate and a terminal connection, which are arranged around the coil element. In at least one embodiment, a coil is wound on the coil element, the two ends of which are weldable on corresponding coil terminals from the same side.

7 Claims, 4 Drawing Sheets

SHORT-CIRCUIT RELEASE HAVING AN OPTIMIZED COIL CONNECTION

PRIORITY STATEMENT

This application is a divisional of and claims priority under 35 U.S.C. §§120/121 to U.S. patent application Ser. No. 13/541,015, filed on Jul. 3, 2012, which claims priority under 35 U.S.C. §119 to European patent application number EP 11172627.9 filed on Jul. 5, 2011, the entire contents of each of which are hereby incorporated herein by reference.

FIELD

The present invention generally relates to a short-circuit release, in particular for a power circuit-breaker having an armature and a pole, that are located inside a coil element, as well as a yoke plate and a terminal connection, which are arranged around the coil element.

BACKGROUND

Short-circuit releases are used in power circuit-breakers for switching and protecting motors and other loads. These short-circuit releases are designed as electromagnetic releases, which essentially include a coil winding, a coil element, an armature, a pole, a plunger, a restraining spring and a yoke. The armature is attracted at a specific rated current of the power circuit-breaker, for instance at twelve times the nominal current in the case of motor protection or at nineteen times the nominal current in the case of transelement protection. The armature's motion therein acts upon a breaker mechanism and on a moveable contact member in order to open the contacts. The relevant standard therein specifies that the operating current can vary by at most +/−20%.

Because of the requisite larger supporting cross-sections, smaller numbers of turns, wider tolerances for the coil and wrap wire, and the greater magnetic-field inhomogeneity associated therewith, the difficulty with relatively wide adjustment ranges lies in positioning the coil winding with respect to the air gap between the armature and pole sufficiently accurately to enable the operating limits to conform to the relevant standard. There is also the problem of fixing the coil winding in its determined position with respect to the air gap so that the coil winding will not become displaced in the direction of the center of gravity of the iron at the rated current or when the short-circuit current is high, or if the coil contracts and becomes deformed with the result that the operating limits will then no longer be adhered to.

For higher breaking capacities, the coils are produced having the winding turns resting on them so that the coil cannot contract and become deformed in the event of high short-circuit currents. Owing to the use of uniform coil elements for the respective structural size and the fact that they are designed for the geometrically largest coil winding, there is often a gap between the coil element flange or yoke and the last turn of the coil winding. In order to fix the coil winding once it has been positioned accurately with respect to the air gap between the armature and pole, one of the coil winding's ends is bonded to the coil-element flange or yoke and the other is welded to a terminal.

In the case of power circuit-breakers having a high breaking capacity, for example up to 100 kA for a nominal current of 80 A, the current release module must be completely redimensioned in order to control the thermal stress and to achieve the release behavior required therefor. The power rating in the case of the short circuit release increases here on account of the increased contact load. It should also be noted that the power loss of an 80-A release is not permitted to be greater than that of the 50-A release in order to prevent an increase in the temperature. This means that in accordance with the overall design of the short-circuit release the magnetic circuit must be designed more efficiently.

With the previously known 80-A devices, a shock armature system was dispensed with. A different force level was used to configure the short-circuit release. The release only has to release the breaker mechanism and not impinge on the contact bridge. This allows for a much more unfavorable magnetic system. The disadvantage here is that a contact welding can be prevented with more difficulty.

SUMMARY

A short-circuit release is provided, in particular for a power circuit-breaker, that has an improved magnetic circuit with a high breaking capacity and in this way enables an optimized manufacturing process.

Advantageous embodiments and developments that can be used individually or in combination with each other are the subject matter of the dependent claims.

At least one embodiment is directed to a short-circuit release, in particular for a power circuit-breaker, having an armature and pole that are located inside a coil element and further having a yoke plate and terminal connection that are arranged around the coil element. In at least one embodiment, a coil is wound on the coil element, the two ends of which can be welded to corresponding coil terminals from the same side.

BRIEF DESCRIPTION OF THE DRAWINGS

Further advantages and embodiments of the invention are explained below with the aid of example embodiments and with the aid of the drawing, in which.

Figure 1:
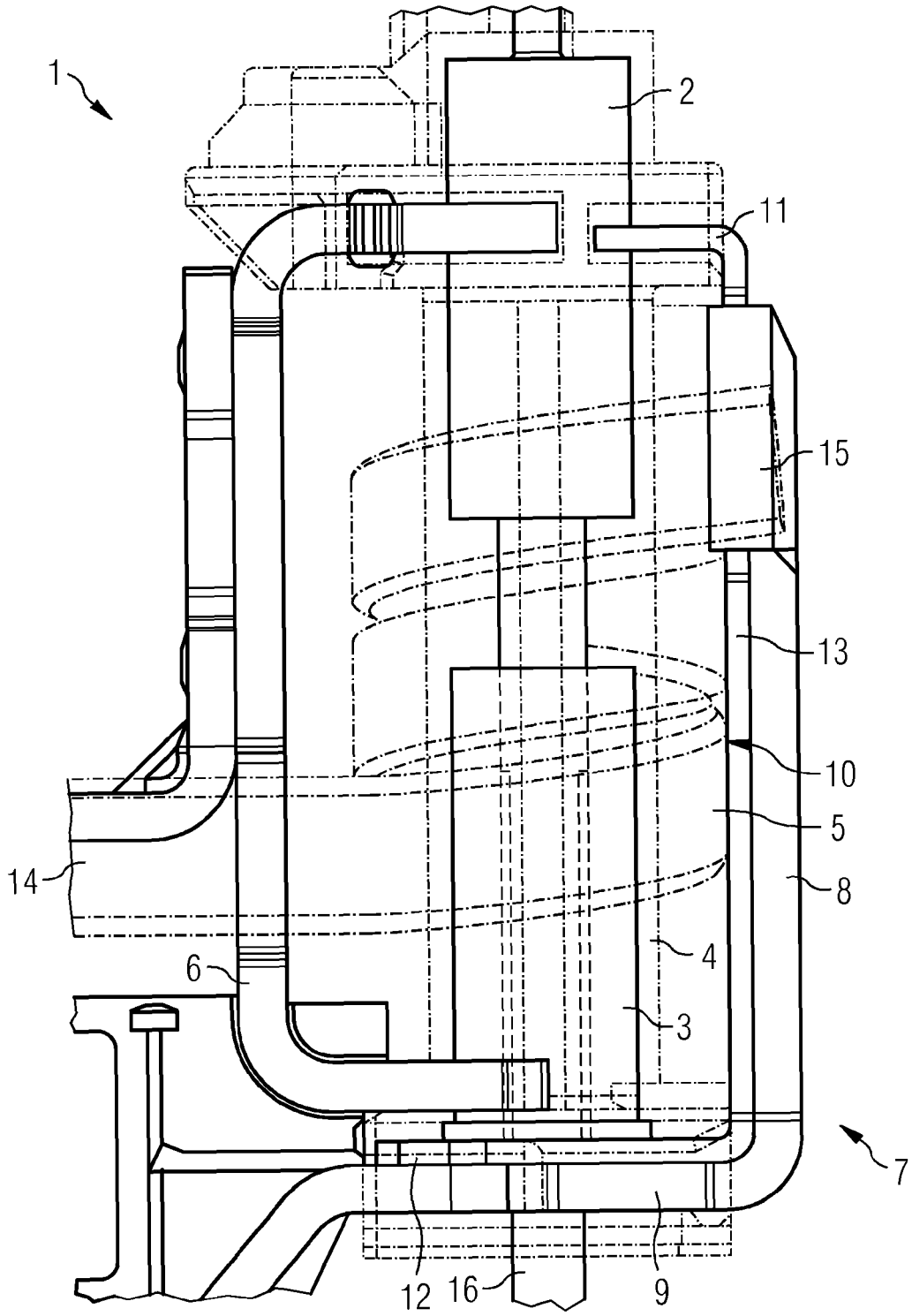
FIG. 1 shows a perspective representation of a partial cut-out of an inventive short circuit release having an arrangement comprising coil element, armature, pole and coil.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment is directed to a short-circuit release, in particular for a power circuit-breaker, having an armature and pole that are located inside a coil element and further having a yoke plate and terminal connection that are arranged around the coil element. In at least one embodiment, a coil is wound on the coil element, the two ends of which can be welded to corresponding coil terminals from the same side.

The coils are arranged, in at least one embodiment, in a way which is not to be negatively affected in terms of its functionality and in a way which also offers an improved or even optimized manufacturing process. The coil is positioned such that it lies vertically in the center from the coil element. The armature and pole are then positioned for the optimal degree of efficiency of the coil. The maximum air gap between the armature and the pole is defined such that this lies in the vertical center of the coil. The coil terminal to the bimetal can be pulled straight without defined contour bends and/or complicated moldings in order to ensure parallelism relative to the bimetal. The winding direction permits the rectilinear embodiment of the connection to the bimetal.

The inventive coil of at least one embodiment is manufactured as a whole without an additional connecting piece between the bimetal and coil or coil to terminal connection. This is advantageous in that both parts and also welding points are saved and therefore also their resistance. The welding connections of the coil can be manufactured from the same side. The coil terminal to the terminal connection can be pulled straight and directly to the terminal connection. No deflection or other molding relative to the terminal is required. There is no risk of the coil element melting when the joint is welded between the coil and the terminal connection.

The horizontally adjusted position of the inventive coil of at least one embodiment shortens the length of the electrical connections, in other words between the coil and terminal connection and/or between coil and bimetal. The saved resistance can be used for coil design purposes. The magnetic circuit, which is slightly impaired on account of the increased current path, is compressed by the increased electrical excitation without the resistance increasing from the overall release. A thermal increase in the overall temperature of the current release is not provided and/or is prevented. This is decisive of the dimensioning of the temperature of the terminal connection and/or the overall device. A standard device is provided as a result.

The inventive short-circuit release of at least one embodiment, in particular for a power circuit-breaker, has an armature and pole that are located inside a coil element. A coil is wound onto the coil element. The coil element is framed by a yoke plate and a terminal connection. The yoke plate is embodied preferably as U-shaped. The terminal connection surrounds the coil element including the coil preferably with two limbs arranged at right angles to one another. Arranged on the terminal connection's two limbs is preferably a magnetic plate that is embodied preferably as U-shaped and has two limbs as well as a transitional region. The magnetic plate's transitional region therein rests against a limb of the terminal connection. The first magnetic plate's limbs rests against the second limb of the terminal connection. The magnetic plate's second limb is anchored in the coil element. The coil has two ends. The one end of the coil is connected to a bimetal. The second end of the coil is welded directly on the terminal connection. Both ends of the coil can be welded to the coil terminals from the same side so that welding connections only have to be set from one side. Accordingly, the module need not be reversed during assembly for the welding connections.

An inventive winding of at least one embodiment of the coil allows for a rectilinear and direct connection of the coil ends to their terminals within the module, so that no undefined contour bends and/or complicated moldings are needed. The coil ends run approximately parallel to one another and offer a good welding option on account of their rectilinearity. The coil ends can be arranged in a plane. It is however also conceivable for the planes of the coil ends to have a minimal offset, which is clearly smaller than the diameter of the coil element.

To improve or even optimize the magnetic circuit, provision can also be made in accordance with of at least one embodiment the invention for a magnetic plate to be arranged opposite the yoke plate on the terminal connection. The arrangement comprising yoke plate and magnetic plate is embodied here such that these are manufactured from two individual parts without direct mechanical connection to the terminal connection. The terminal connection is likewise embodied here as a single part, which is used as a current path. The additional magnetic plate considerably reduces the magnetic loss. The magnetic plate is not platinized, and is only placed in the area where this is necessary in terms of magnets. A form-fit pairing is provided between the magnetic plate and the terminal connection.

A depression and/or embossing is preferably embodied in the magnetic plate. This is arranged parallel to the axis of the center of the axis of the short circuit release in order to allow for the necessary space requirement for the adjacent coil windings. The required cross-section can vary here to such a degree as is required by the design of the coil. This also enables optimization of the assembly space in the overall device and enables manufacturing tolerances. A corresponding clearance in the terminal connection is a prerequisite for the implementation of the embossing on the magnetic plate.

A recess is also provided on the magnetic plate, so that the coil end can be directly welded on the terminal connection. By individually pairing the parts comprising the magnetic plate and the terminal connection, this separate recess can be produced. This enables an optimized welding connection and a minimal electrical resistance, because two similar materials can be welded herewith. A welding directly on the magnetic plate or a platinized strip material considerably impairs the magnetic current circuit and results in increased manufacturing costs on account of a potentially additional welding.

A further option resides in using a bent welding region on the terminal connection, which in this way offers a surface which can be used to connect the parts. The size of this surface is optimized according to the necessary current transfer and the most minimal electrical resistance. A welded connection can herewith be implemented similarly to a soldered connection.

The individual parts comprising the magnetic plate and terminal connection can be treated as bulk material, but need not however be connected to one another in a form-fit fashion. An exterior molding and attuning of the tolerances allow the parts to be placed into one another and inserted coherently into the coil element so that the magnetic plate is pressed directly onto the pole surface from below. A fixed connection of the parts is cost-intensive. The accurately-fitting installation and/or accurately-fitting impression into the cavity of the coil element circumvents this.

The inventive short-circuit release for high switching capacities of at least one embodiment has both an optimized magnetic circuit and also a coil connection which is improved in the manufacturing process. In particular, the coil terminals, which are placed on the same side of the short circuit release by way of welded connections, contribute to an improved or even optimized manufacturing process. The magnetic plate which is additionally used enables a good magnetic design, wherein the electrical loss is reduced. A standard switching device therefore results overall for high switching capacities, which has both an improved magnetic circuit and also an optimized manufacturing process.

FIG. 1 shows an embodiment of an inventive short circuit release 1, in particular for a power circuit-breaker comprising an armature 2 and a pole 3, which are arranged inside the coil element 4. A coil 5 is wound on the coil element 4. The coil element 4 is surrounded by a yoke plate 6 and a terminal connection 7. The yoke plate 6 is preferably embodied as U-shaped. The terminal connection 7 surrounds the coil element 4 and the coil 5 preferably with two limbs 8, 9 which are at right angles to one another. A magnetic plate 10 is preferably arranged on the two limbs 8, 9 of the terminal connection 7, said magnetic plate 10 preferably being embodied as U-shaped and having two limbs 11, 12 and a transition region 13. In this way the transition region 13 of the magnetic plate 10 rests on the limb 8 of the terminal connection 7. The limb 12 of the magnetic plate 10 rests on the limb 9 of the terminal connection 7. The limb 11 of the magnetic plate 10 is anchored in the coil element 4. The coil 4 comprises two ends 14, 15. The magnetic plate 10 has a depression 20 arranged in the magnetic plate. The depression 20 in the magnetic plate 10 is arranged axially parallel to the center of axis of the short-circuit release 1. The end 14 of the coil 5 is connected to a bimetal (not shown). The end 15 of the coil 5 is welded to the terminal connection 7. A plunger 16 is arranged below the limb 9 of the terminal connection 7, and is guided in a contact sliding apparatus of the power circuit-breaker (not shown).

Figure 2:
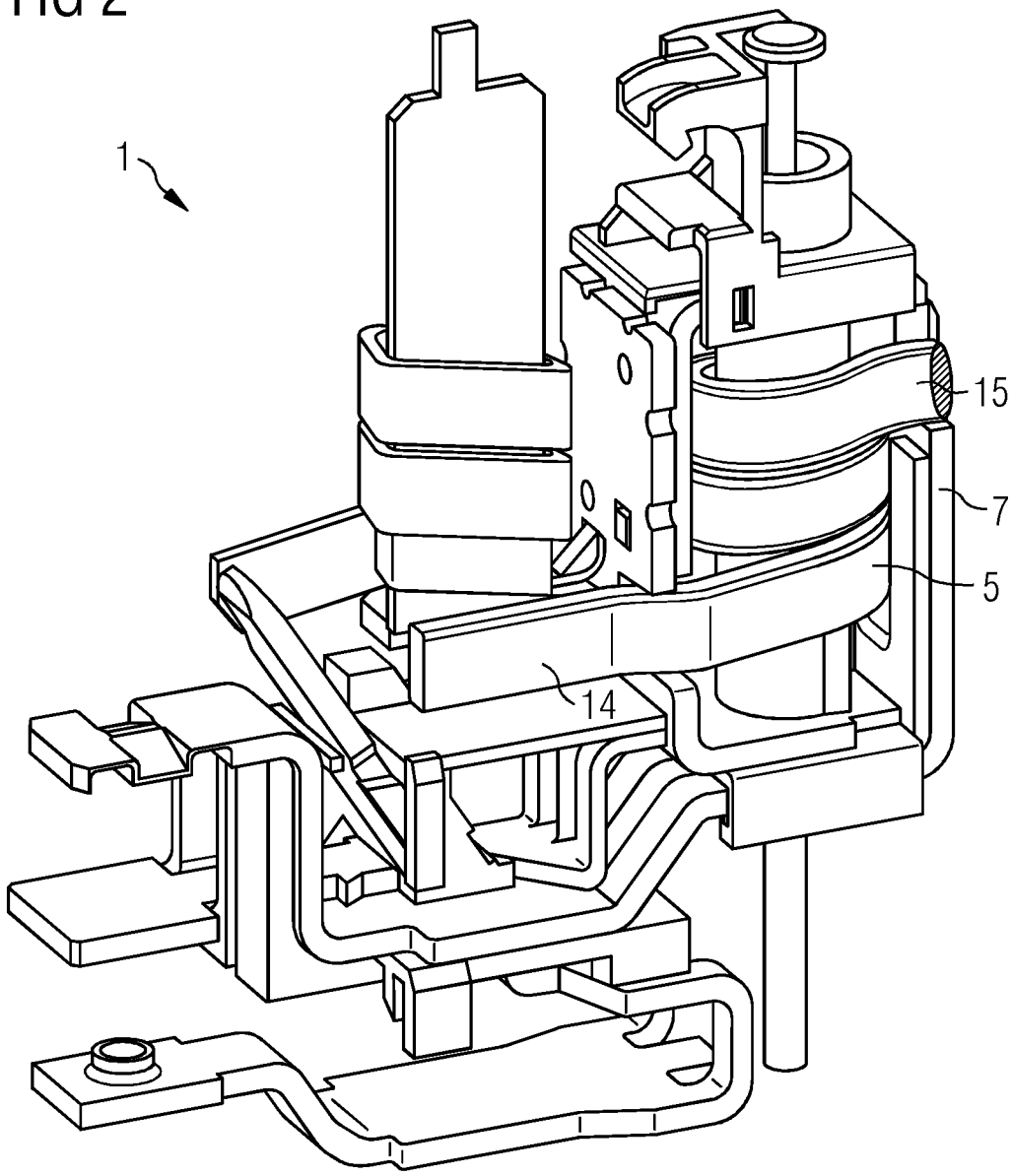
FIG. 2 shows a perspective representation of an example embodiment of the inventive short-circuit release having a special coil winding and/or special coil terminal.

FIG. 2 shows an embodiment of the inventive short circuit release 1 having a special coil winding and/or having a special coil terminal. In this way the end 14 of the coil 5 is connected to the bimetal, while the end 15 of the coil 5 is welded directly on the terminal connection 7. Known welding methods are used for the welding process. It is possible in manufacturing terms for a separation of the active side to be necessary in the welding region of the bimetal. It is apparent from FIG. 2 that the ends 14, 15 of the coil 5 are almost parallel to one another and either lie in a plane or approximately in a plane. In this way the coil terminal of the coil 5 relative to the terminal connection 7 is rectilinear and pulled directly toward the terminal connection 7. No bending or other molding relative to the terminal connection 7 is needed.

Figure 3:
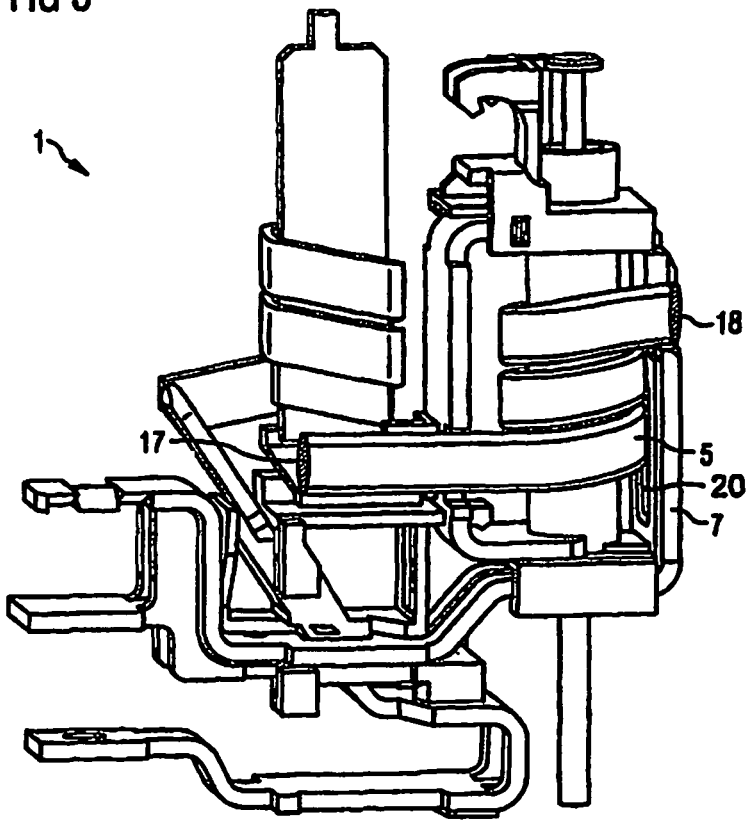
FIG. 3 shows a perspective representation of the example embodiment according to FIG. 2 having the welded connections for the coil terminal.

FIG. 3 shows the example embodiment according to FIG. 2 having the welded connections 17, 18 for the coil terminals on the terminal connection 7 and on the bimetal.

Figure 4:
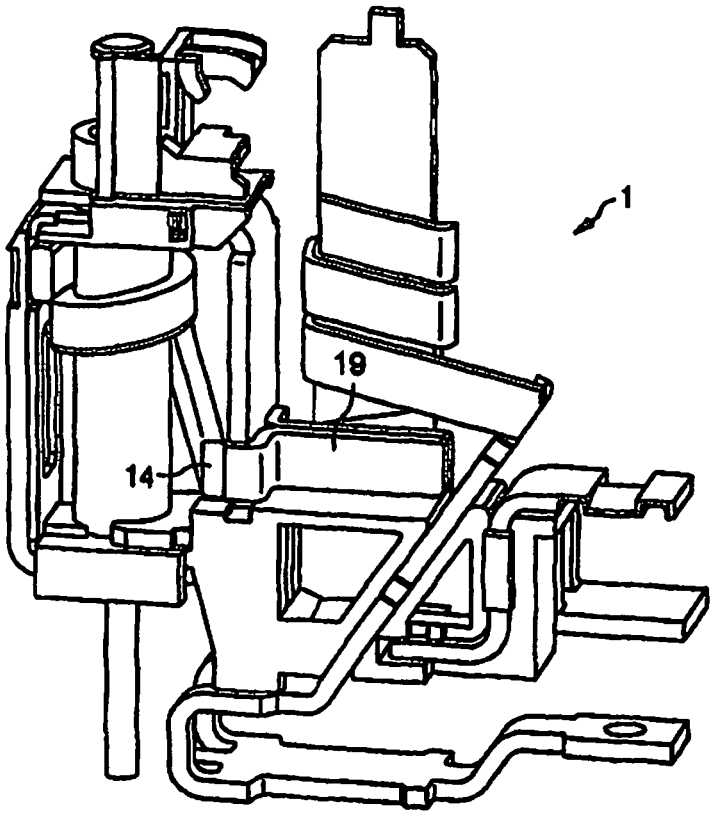
FIG. 4 shows a perspective representation of a second example embodiment of an inventive short-circuit release, wherein an intermediate piece is arranged between the coil end and the bimetal.

FIG. 4 shows a second example embodiment of an inventive short circuit release 1, wherein an intermediate piece 19 is arranged between the end 14 of the coil 5 and the bimetal.

The inventive short circuit release for high switching capacities of an embodiment has both an optimized magnetic circuit and also an improved coil connection in the manufacturing process. In particular, the coil terminals, which are placed on the same side of the short circuit release by way of welded connections, contribute to an optimized manufacturing process. The additionally used magnetic plate enables a good magnetic design, wherein the electrical loss is reduced. A standard switching device for high switching capacities thus results overall, which has both an improved magnetic circuit and also an optimized manufacturing process.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A short-circuit release, comprising:

an armature and a pole, arranged inside a coil element; and a yoke plate and a terminal connection, arranged around the coil element; and a coil, wound on the coil element, two ends of the coil being windable on corresponding coil terminals from the same side, wherein a magnetic plate is arranged on the terminal connection opposite to the yoke plate.

2. The short-circuit release of claim 1, wherein the terminal connection includes a depression in a region of a coil terminal welding.

3. The short-circuit release of claim 1, wherein a bent welded region is embodied on the terminal connection so that a surface exists for a welded connection between the coil and the terminal connection.

4. The short-circuit release of claim 1, wherein the short-circuit release is for a power circuit-breaker.

5. A short-circuit release, comprising:

an armature and a pole, arranged inside a coil element; and a yoke plate and a terminal connection, arranged around the coil element; and a coil, wound on the coil element, two ends of the coil being windable on corresponding coil terminals from the same side, wherein the magnetic plate and the terminal connection are arranged in a form-fit fashion relative to one another.

6. A short-circuit release, comprising:

an armature and a pole, arranged inside a coil element; and a yoke plate and a terminal connection, arranged around the coil element; and a coil, wound on the coil element, two ends of the coil being windable on corresponding coil terminals from the same side, wherein a depression is arranged in the magnetic plate.

7. The short-circuit release of claim 6, wherein the depression in the magnetic plate is arranged axially parallel to the center of axis of the short-circuit release.

* * * * *